US008043130B2

(12) United States Patent
Casses et al.

(10) Patent No.: US 8,043,130 B2
(45) Date of Patent: Oct. 25, 2011

(54) FEMALE ELECTRICAL CONTACT COMPRISING SPRING CONTACT PLATES

(75) Inventors: Claude Casses, Clevilliers (FR); Dominique Rozet, Rambouillet (FR)

(73) Assignee: FCI Automotive Holding, Guyancourt (FR)

( * ) Notice: Subject to any disclaimer, the term of this patent is extended or adjusted under 35 U.S.C. 154(b) by 442 days.

(21) Appl. No.: 11/884,108

(22) PCT Filed: Jan. 31, 2006

(86) PCT No.: PCT/EP2006/000843

§ 371 (c)(1), (2), (4) Date: Dec. 22, 2009

(87) PCT Pub. No.: WO2006/084608

PCT Pub. Date: Aug. 17, 2006

(65) Prior Publication Data

US 2010/0130075 A1 May 27, 2010

(30) Foreign Application Priority Data

Feb. 9, 2005 (FR) ..... 05 50385

(51) Int. Cl.
*H01R 11/22* (2006.01)

(52) U.S. Cl. ..... 439/850

(58) Field of Classification Search ..... 439/850–858
See application file for complete search history.

(56) References Cited

U.S. PATENT DOCUMENTS

| | | | | |
|---|---|---|---|---|
| 3,836,947 | A | 9/1974 | Yeager | 339/259 R |
| 4,564,259 | A * | 1/1986 | Vandame | 439/852 |
| 5,112,254 | A * | 5/1992 | Endo | 439/852 |
| 5,281,175 | A | 1/1994 | Chupak et al. | 439/839 |
| 5,350,321 | A * | 9/1994 | Takenouchi | 439/839 |
| 5,601,458 | A * | 2/1997 | Ohsumi et al. | 439/852 |
| 5,791,945 | A * | 8/1998 | Myer et al. | 439/852 |
| 5,897,405 | A | 4/1999 | Endo | 439/852 |
| 5,906,502 | A | 5/1999 | Fasano | 439/395 |
| 6,206,738 | B1 * | 3/2001 | Sugie | 439/852 |
| 6,305,992 | B1 | 10/2001 | Bouda et al. | 439/834 |
| 6,428,366 | B1 | 8/2002 | Purushothaman et al. | 439/851 |
| 6,475,040 | B1 | 11/2002 | Myer et al. | 439/852 |
| 6,527,601 | B2 | 3/2003 | Chen | 439/852 |
| 6,547,608 | B2 | 4/2003 | Sato et al. | 439/852 |
| 6,790,101 | B1 * | 9/2004 | Data et al. | 439/851 |
| 2003/0216085 | A1 | 11/2003 | Maeda | 439/852 |

FOREIGN PATENT DOCUMENTS

| | | |
|---|---|---|
| JP | 9-232021 | 9/1997 |
| JP | 09232021 A | 9/1997 |
| JP | 10-55838 A | 2/1998 |
| JP | 2000/133356 A | 5/2000 |
| JP | 2006-134681 | 5/2006 |

* cited by examiner

*Primary Examiner* — Truc Nguyen

(74) *Attorney, Agent, or Firm* — Harrington & Smith

(57) ABSTRACT

The invention relates to a female electrical contact including a housing which is cut and folded from a metal strip and which includes at least one contact plate which extends along the longitudinal axis (A) of the housing and which is equipped with a section that is in contact with a complementary contact pin. According to the invention, the contact plate includes part for connecting to the housing and a free end. The invention also includes a spring element which is cut from the extension of the contact plate prior to folding, such as to form a counter plate after folding. The spring element and the plate are provided, for example, on either side of the above-mentioned connection part.

11 Claims, 4 Drawing Sheets

Figure 1:
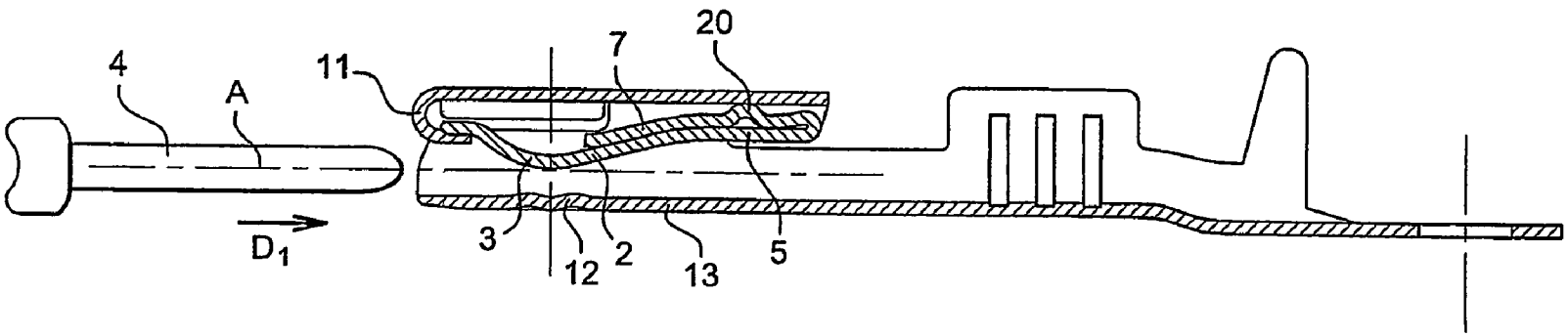

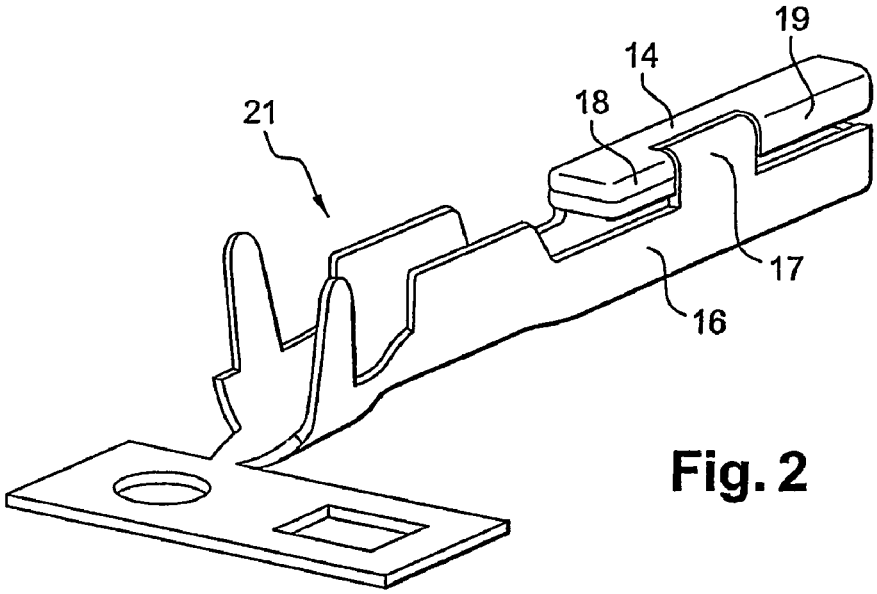
Fig. 2
Fig. 3
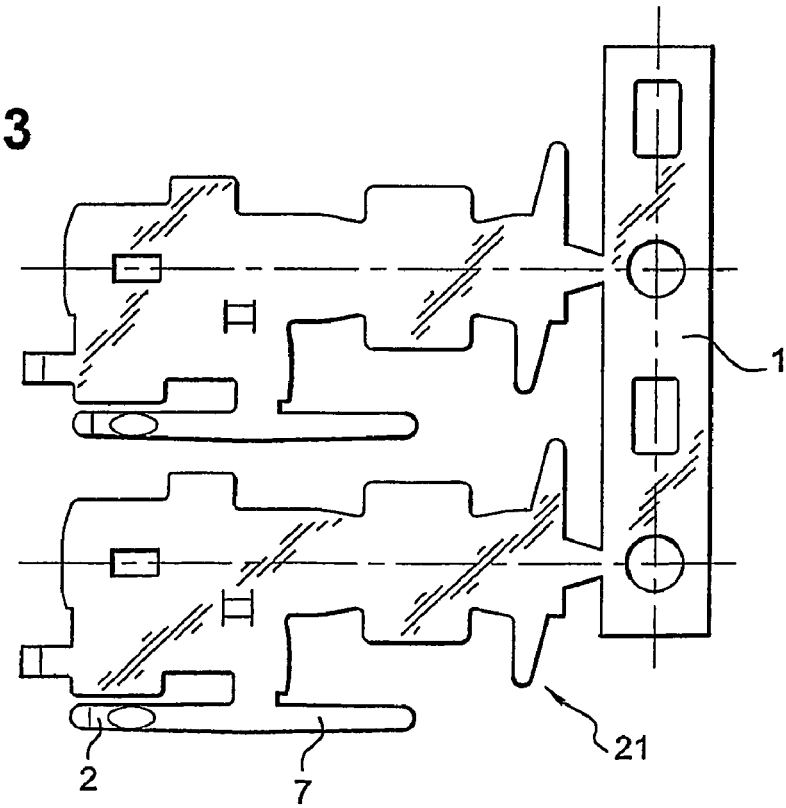

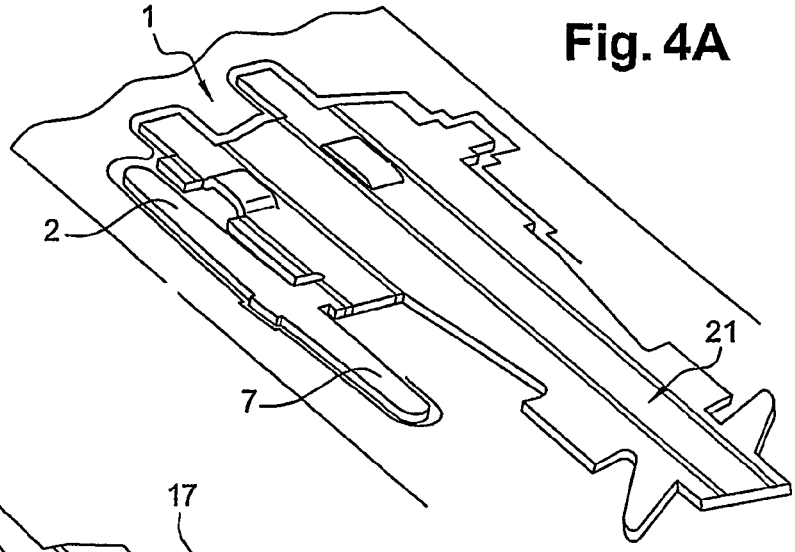
Fig. 4A
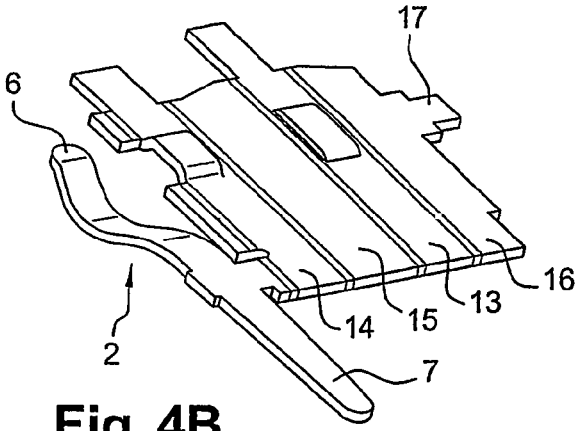
Fig. 4B
Fig. 4C
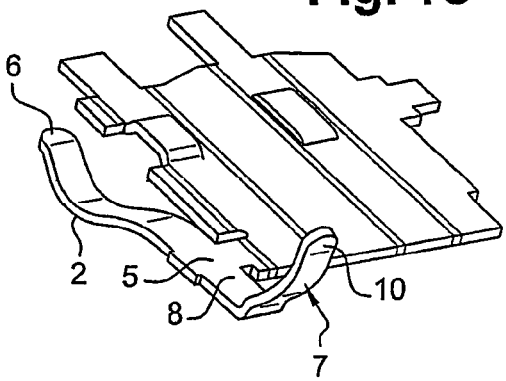
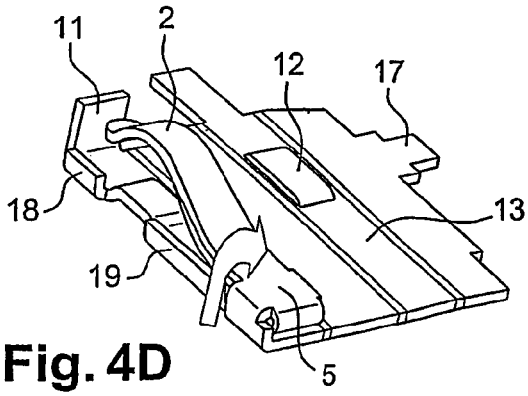
Fig. 4D

FEMALE ELECTRICAL CONTACT COMPRISING SPRING CONTACT PLATES

The present invention concerns a female electrical contact with spring contact plates.

Female contacts comprising a housing of quadrilateral section and provided with inner contact plates made by cutting and folding a metal strip designed to create an electrical contact by cooperation with complementary contact pins frequently have a spring element in addition to the contact plate, permitting a sufficient contact pressure to be guaranteed during the coupling of said female contacts and said contact pins.

This spring element, which is applied onto one part of the contact plate, is either cut and folded from the metal sheet intended to create the housing, or is added and inserted into the housing.

One example of creating a female contact with a housing provided with inner spring contact plates having an additional spring element is described in document JP 9-232021.

According to one embodiment described in this document, a spring contact plate precut in the metal strip and folded from the back to the front of the housing is prestressed by a spring element that is itself also cut in the metal sheet and folded from the front of the housing towards the back of the housing.

In one variant of embodiment described in this document, a spring element, cut and then folded from back to front, comes to rest on a contact plate folded from back to front when a contact pin is inserted.

However, this spring element is set apart from the contact plate in the absence of a complementary contact pin.

According to this embodiment, a structure folded from the front of the housing protects the plate during introduction of a complementary contact pin. This structure is, however, not in contact with the free end of the plate.

The present invention seeks to improve spring plate contacts, particularly by assuring a significant contact pressure by application of a prestress on the spring plate, while keeping small the outer dimensions of the contact and limiting the number of necessary folding operations.

To do this, the present invention principally concerns a female electrical contact with housing cut and folded from a metal sheet and comprising at least one contact plate, extending along a longitudinal axis of the housing and, provided with a section for contact with a complementary contact pin, the contact plate comprising a part for connecting to the housing and a free end, characterized in that it has a spring element cut out in a lengthways extension of said contact plate before folding and this spring element forms a counter-plate after folding.

More particularly, the spring element and the plate are made on either side of the connecting part.

Thus, the plate and the counter plate are cut out in a lengthways extension of the same metal sheet, one being folded back on the other so as to be found entirely enclosed in the housing after folding.

Figure 5A:
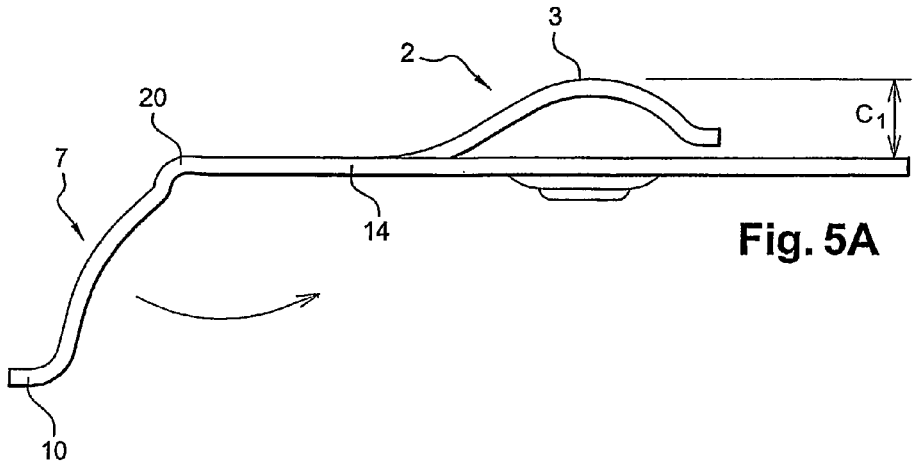
Figure 5B:
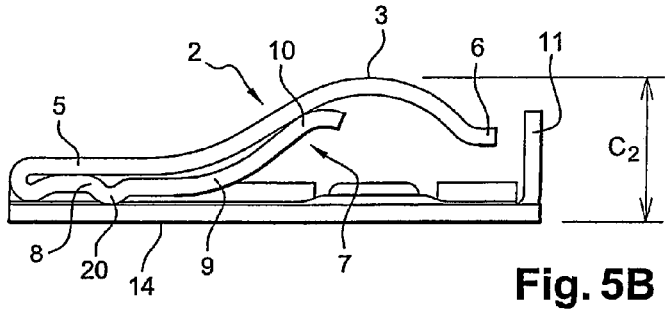
Figure 5C:
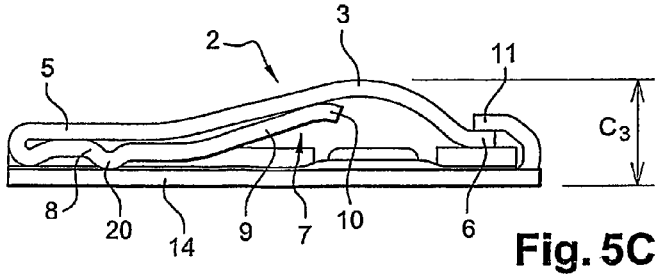

Other characteristics and advantages of the invention will be better understood upon reading the description that follows of one non-limiting example of embodiment of the invention in reference to the figures, which show:

FIG. 1: a side view in section of a female contact according to the invention facing a complementary pin;

FIG. 2: a three-quarter rear perspective view of the contact of FIG. 1;

FIG. 3: a part of the metal sheet cut out to create the contact of FIG. 1;

FIGS. 4A to 4D, perspective views of the successive stages of creation of the contact of FIG. 1;

FIGS. 5A to 5C: side views of the stages of manufacture of FIGS. 4C and 4D and a step of folding a flap according to the invention.

The female electrical contact with housing shown in FIG. 1 is designed to receive a complementary pin 4. This contact, cut and folded from a metal sheet 1 shown in FIG. 3 comprises at least one contact plate 2, extending along a longitudinal axis A of the housing.

The contact plate is created in the metal sheet made up of a metal alloy possessing good electrical characteristics and a sufficient stiffness so that the plate has spring qualities that guarantee a significant contact pressure on complementary pin 4. Alloys conforming to these characteristics are, for example, copper-beryllium alloys with or without nickel plating.

The contact and particularly the housing are created by successive folding of metal sheet 1.

The housing is formed by successive folding operations in sequence and, by following the folding operation of FIG. 4A, one finds in the following order: a strip piece in which both the plate and the counter-plate are created, a strip piece designed to create an upper wall 14 bearing the plate, a strip piece designed for a first lateral wall 15 of the housing, a lower wall 13 of the housing bearing a boss 12, and a strip piece designed to form at least part of a second lateral wall 16 of the housing.

The folding of metal sheet 1 begins by forming the curvature of plate 2 and of the counter plate constituted by spring element 7 as shown in FIGS. 4B and 4C.

Then, connecting part 5 is folded laterally on a wall 14 of the housing after the spring element rests on plate 2, as shown in FIG. 4D.

At that time the plate and the counter-plate are protected by wall 14 and definitively formed and the counter-plate is imprisoned between wall 14 and plate 2.

According to this embodiment, the plate and the counter-plate are cut out of an outer edge of the metal sheet to then be entirely enclosed in the housing after folding.

The rest of the folding is then carried out around a lower wall 13, which is extended in its length direction by a segment 21 for connecting a cable, by a first folding operation forming, on one side of this lower wall 13, the upper wall 14 bearing the plate, a second folding operation forming a first lateral wall 15 and, on the other side of this lower wall 13, at least a part of second lateral wall 16.

In order to create the electrical contact, the plate is provided with a section 3 for contact with complementary contact pin 4.

In the case of the example described, the pin, once introduced into the housing, is clamped between the contact plate and boss 12 created in a floor 13 of the housing, this floor being extended in this example by part 21 for connecting to a traditional cable, which will not be further explained here.

Contact plate 2, created by cutting and folding, is finally found positioned under wall 14 opposite the floor 13 of the housing.

In the direction of the longitudinal axis of the housing, from back to front, the plate comprises one end or part 5 for connecting to the housing, a contact section 3 and a free end 6, contact section 3 being in an intermediate part of the plate between the end for connecting to wall 14 and free end 6.

The contact according to the invention has, in parallel with said plate 2, a spring element 7 comprising an end 8 for connecting to the housing, which in the example is attached to part 5 of plate 2 for connecting of this plate 2 with the housing, an intermediate part 9 running along the plate and a free end 10 applied onto a side of the plate opposite the side of the plate designed to come into contact with the complementary pin.

This spring element is formed so as to press the plate in the direction perpendicular to longitudinal axis A of the housing towards the inside of the housing.

Female contact 2 according to the invention also has a flap 11 that extends the front of wall 14 of the housing bearing plate 2 and which is folded towards the inside of the housing so that the flap is applied onto free end 6 of the plate to bring it towards said wall 14.

According to the example described, the contact has a single plate 2 facing boss 12, disposed on a wall 13 of the housing opposite plate 2 with regard to said axis A.

The housing must have good resistance to bending or torsion and, according to a particular embodiment, wall 14 bearing the plate has at least one turned-down lateral part 18, 19, particularly shown in FIG. 4D and forming a complementary element for wall 16.

In complement, in order to enclose the housing, said second lateral wall 16 is extended laterally by a tab 17, for inserting between the two lateral turned-down parts 18, 19 of wall 14 bearing the plate in order to rigidify the housing.

Returning to FIG. 1, it is noted that near its end for connecting to the housing, spring element 7 bears a boss 20 supported against wall 14 of the housing bearing plate 2.

This boss 20 permits precisely fixing the articulation point of spring element 7 and therefore limiting fluctuations in the stiffness of this spring, which could appear due to manufacturing deviations.

Advantageously, spring element 7 is curved along a radius of curvature smaller than the radius of curvature of the plate which, at least in the absence of the complementary contact pin, permits assuring that the spring element is supported against plate 2 by its free end 10 and not by any portion whatever of its length, so that the active length of the spring element is clearly determined.

Moreover, in order to increase the contact pressure, said section 3 for contact with contact pin 4 is reduced in size. To do this, the contact section of the plate has a curved contact zone.

According to the example, end 10 of spring element 7 is applied onto plate 2 at the rear part of said contact zone relative to direction D of insertion of complementary contact pin 4.

According to the example, the plate and the spring element extend from back to front (the receiving part of the pin) of the housing, the connecting ends of the spring and the plate 5, 8 being the rear ends of the spring and the plate; the free ends of the spring and plate 6, 10 extend from the back of the housing towards the front of the housing.

The creation of the housing is more particularly shown in FIGS. 4A to 4D and 5A to 5C.

The creation of the female contact is specified below. Beginning with cutting out the strip shown in FIG. 4A, first of all and according to FIG. 4B, the plate is bent into shape and folded so as to deviate from the plane of the metal sheet.

This folding is conducted so that the plate is set apart by a distance C1 from wall 14 bearing plate 2, this distance being shown in FIG. 5A in side view.

As shown in FIGS. 4C and 5A, the spring element is then bent and folded 180° to keep the plate away from the wall by a distance C2, which is greater than distance C1.

In this position, the spring element applies a pressure onto the plate, forcing it to the inside of the housing.

In the particular case of the example shown, the plate-spring element assembly is folded 180° onto the lower surface of wall 14 as shown in FIG. 4D to position the plate and the spring element as shown in FIG. 5B.

Finally, and according to FIG. 5C, flap 11 is applied against end 6 of the plate on the surface opposite the surface of the plate receiving the spring element to bring the plate back to a distance C3 from said wall, distance C3 being less than distance C2 so that the pressure applied onto the plate by the spring element is increased and so that the position of the plate in the housing is established in a precise manner with regard to the inner dimensions of the housing and axis D for introduction of contact pin 4.

After these operations, the strip pieces that will form the walls of the housing are bent in sequence and tab 17 is then bent to close the housing.

Thus, the contact according to the invention remains small in size due to the small number of necessary folding operations, the contact pressure is high due to the presence of a counter-plate created from a spring element imprisoned between the wall bearing the contact plate and this contact plate, and the folded housing no longer has openings or projecting parts that can damage the joints through which the contact must be positioned within the scope of automobile connection applications.

The invention is not limited to the example shown and is applicable, particularly, to a contact having two contact plates face to face.

The invention claimed is:

1. A female electrical contact with housing cut and folded from a metal sheet and comprising at least one contact plate, extending along a longitudinal axis (A) of the housing, and, provided with a section for contact with a complementary contact pin, the contact plate comprising a part connecting to the housing and free ends, having a spring element cut out in lengthways extension of said contact plate before folding and forming a counter-plate after folding, the spring element including one of the free ends, characterized in that, after folding, the free end of the spring element extends from the back of the housing towards the front of the housing and another one of the free ends of the contact plate extends from the back of the housing towards the front of the housing.

2. The contact according to claim 1, further characterized in that the spring element and the contact plate are created on opposite sides of the part connecting to the housing.

3. The contact according to claim 1, further characterized in that the spring element is supported on the contact plate by means of folding at 180°.

4. The contact according to claim 1, further characterized in that the part connecting to the housing is folded laterally onto a wall of the housing after the spring element rests on the contact plate.

5. The contact according to claim 1, further characterized in that the contact has a single plate facing a boss positioned on a wall of the housing opposite the contact plate with regard to said axis (A).

6. The contact according to claim 5, further characterized in that the housing is created by folding the metal sheet around a lower wall to form an upper wall bearing the contact plate and a first lateral wall on one side of this lower wall and at least part of a second lateral wall on the other side of this lower wall, the contact plate and the counter-plate being cut out of an outer edge of the metal sheet so as to be entirely enclosed in the housing after folding.

7. The contact according to claim 1, further characterized in that the spring element is imprisoned between a wall of the housing and the contact plate and, near the part for connecting to the housing, has a boss for support against the wall of the housing bearing the contact plate and forming a stiffener.

8. The contact according to claim 1, further characterized in that the spring element is curved along a radius of curvature smaller than a radius of curvature of the contact plate so that, at least in the absence of the complementary contact pin, only the free end of the spring element rests against the contact plate.

9. The contact according to claim 1, further characterized in that the contact section of the contact plate has a curved contact zone, the free end of the spring element being applied onto the contact plate at the rear part of said contact zone relative to a direction (D) for insertion of the complementary contact pin.

10. The contact according to claim 1, further characterized in that the spring element and the contact plate comprise rear ends connecting the spring element and the contact plate to the part connecting to the housing.

11. A female electrical contact with housing cut and folded from a metal sheet and comprising at least one contact plate, extending along a longitudinal axis (A) of the housing, and, provided with a section for contact with a complementary contact pin, the contact plate comprising a part connecting to the housing and free ends, having a spring element cut out in lengthways extension of said contact plate before folding and forming a counter-plate after folding, characterized in that the free ends of the spring element and the plate extend, after folding, from the back to the front of the housing, where the female electrical contact with housing has a flap, extending from a front of a wall of the housing bearing the contact plate and is folded back toward an inside of the housing, the flap being applied onto a first one of the free ends of the contact plate to bring the first free end towards said wall counteracting force applied onto the contact plate by the spring element.

* * * * *